US007762497B2

(12) United States Patent
Roger

(10) Patent No.: US 7,762,497 B2
(45) Date of Patent: Jul. 27, 2010

(54) AUTOMATIC KITESURF RELEASE SYSTEM

(76) Inventor: Donatien Roger, 87 rampe St Gervais, F-76000 Rouen (FR)

( * ) Notice: Subject to any disclaimer, the term of this patent is extended or adjusted under 35 U.S.C. 154(b) by 969 days.

(21) Appl. No.: 10/569,314

(22) PCT Filed: Aug. 4, 2004

(86) PCT No.: PCT/FR2004/002087

§ 371 (c)(1),
(2), (4) Date: Apr. 17, 2006

(87) PCT Pub. No.: WO2005/018768

PCT Pub. Date: Mar. 3, 2005

(65) Prior Publication Data

US 2006/0243862 A1 Nov. 2, 2006

(30) Foreign Application Priority Data

Aug. 19, 2003 (FR) ..... 03 10031

(51) Int. Cl.
*B64C 31/06* (2006.01)

(52) U.S. Cl. ..... 244/155 A

(58) Field of Classification Search ..... 244/155 A, 244/153 R, 904; 114/39.18, 39, 39.16; 248/229.13, 248/229.16, 229.17; 182/3, 9, 4.3, 4; 294/82.24, 294/82.25, 82.36; 59/85, 88, 89; 24/115 F
See application file for complete search history.

(56) References Cited

U.S. PATENT DOCUMENTS 2,418,111 A * 4/1947 Dahlander ..... 294/82.31
2,863,694 A * 12/1958 Gross ..... 294/82.25
3,038,753 A * 6/1962 Seager ..... 294/82.33
3,918,758 A * 11/1975 Fournier ..... 294/82.36

(Continued)

FOREIGN PATENT DOCUMENTS

DE 202 09 515 U1 11/2002

(Continued)

OTHER PUBLICATIONS

Roger, Donatien, Declaration of Donatien Roger under 37 C.F.R. § 1.132, Jul. 21, 2009.

(Continued)

*Primary Examiner*—Tien Dinh
(74) *Attorney, Agent, or Firm*—Myers Bigel Sibley & Sajovec, PA

(57) ABSTRACT

A device is provided which is used automatically to release the lines of a power kite or kitesurf when, under the force of the wind, the bar applies pressure on a quick release jaw clip or snap hook. According to the invention, the rear liens are fixed to the ends of the bar and to the rear ends of the wing. Moreover, the clip or snap hook is connected to the front lines which are in turn connected to the wing and to the user by the device. The device includes front lines, jaw elements belonging to the clip or snap hook; an axle comprising a shackle around which the clip or snap hook pivots; lugs belonging to the clip or snap hook; a spring; a bar having the rear lines attached to the ends thereof; and a cord which is connected to the shackle and to the kitesurfer (or user) by his/her harness.

13 Claims, 11 Drawing Sheets

U.S. PATENT DOCUMENTS

| | | | | |
|---|---|---|---|---|
| 4,279,062 | A | 7/1981 | Boissonnet | |
| 6,273,369 | B1 | 8/2001 | Nishimura et al. | |
| 6,514,115 | B2 * | 2/2003 | Harich | 446/34 |
| 7,017,860 | B2 * | 3/2006 | Royannais et al. | 244/155 A |
| 7,127,781 | B2 * | 10/2006 | Ponting et al. | 24/136 R |
| 2004/0065780 | A1 * | 4/2004 | Bellacera | 244/155 A |
| 2004/0182968 | A1 * | 9/2004 | Gentry | 244/155 A |

FOREIGN PATENT DOCUMENTS

| | | | |
|---|---|---|---|
| DE | 203 02 460 | U1 | 6/2003 |
| EP | 1 302 398 | A2 | 4/2003 |

OTHER PUBLICATIONS

Wichard 2009 Catalogue, 28 pages.

"Safety-Quick Release from WICHARD—the one and only !!" https://www.kiteforum.com/viewtopic.php?f=1&t=4780, Jun. 25, 2009, 9 pages.

"Warning to Snap Shackle Users!!!" http://kiteforum.com/viewtopic.php?f=1&t=5202, Jun. 25, 2009, 27 pages.

* cited by examiner 10
11
2
12A
14
8
9
13A
5'

AUTOMATIC KITESURF RELEASE SYSTEM

BACKGROUND (1) Field of the Invention

The present invention concerns a device for automatically releasing the front lines of a kitesurfing sail (or traction kite) consisting of a board or surfboard and a traction sail of the kite or paragliding type equipped with at least four lines, in order to release the kitesurfer (or pilot), himself attached by his harness to the front lines ("small end"). The present invention also concerns traction sails controlled on the ground or from a running device of the sandsailing or skateboarding type, or sliding device of the snowboard or ski type.

(2) Prior Art

Some kitesurfing (or traction) sails with four lines are equipped with a device which enables the user to release himself from the front lines by manually pulling a loop, situated within reach of his hand. Since this system is not automatic, several users have before now been killed or seriously injured because they have not been able to release themselves from the sail and have been drawn towards the beach and then thrown against obstacles, because of the power of the sail. These manual release systems assume that the user is perfectly conscious and in full possession of his faculties, and that the device is 100% operational. The manual release systems are often composed of loops of interlocking cords held by a metal rod that can be actuated by a pull cord. In addition, it has often been found that these devices do not function routinely, because of friction and sand. The fundamental problem stems from the fact that the user is continuously attached by the front lines to the four-line kite, and falls and/or loses balance, loses control of the kite and however remains attached to the kite, which continues to fly and drag him; this is not the case with other sports such as windsurfing or water-skiing, which do not present this danger: if the windsurfer or skier releases the wishbone or bar, they simply fall in the water.

SUMMARY OF THE INVENTION

The device according to the invention remedies this major drawback. This is because, as soon as the user releases the bar holding the rear lines of the kite by its ends and inside which the front lines slide, the power of the wind in the kite pulls the bar along the front lines; the bar comes into abutment against the pressure release device and then releases the front lines. The kite then no longer being held except by the rear lines connected to the bar, it can no longer fly, ends up by falling to the ground or in the sea and then stops dragging the user.

According to particular embodiments:

the device can comprise a clamp with jaws holding a loop on which the front lines are fixed; the bottom arms of the clamp are held by a spring; the bottom arms separate as soon as the bar comes into abutment on the arms, which has the effect of separating the jaws and therefore releasing the front lines.

BRIEF DESCRIPTION OF THE DRAWINGS

The device can in a variant (A') comprise a snap hook (A') articulated for opening under load by pressure, in place of a clamp (A) for opening under load by pressure.

Figures 1, 1A:
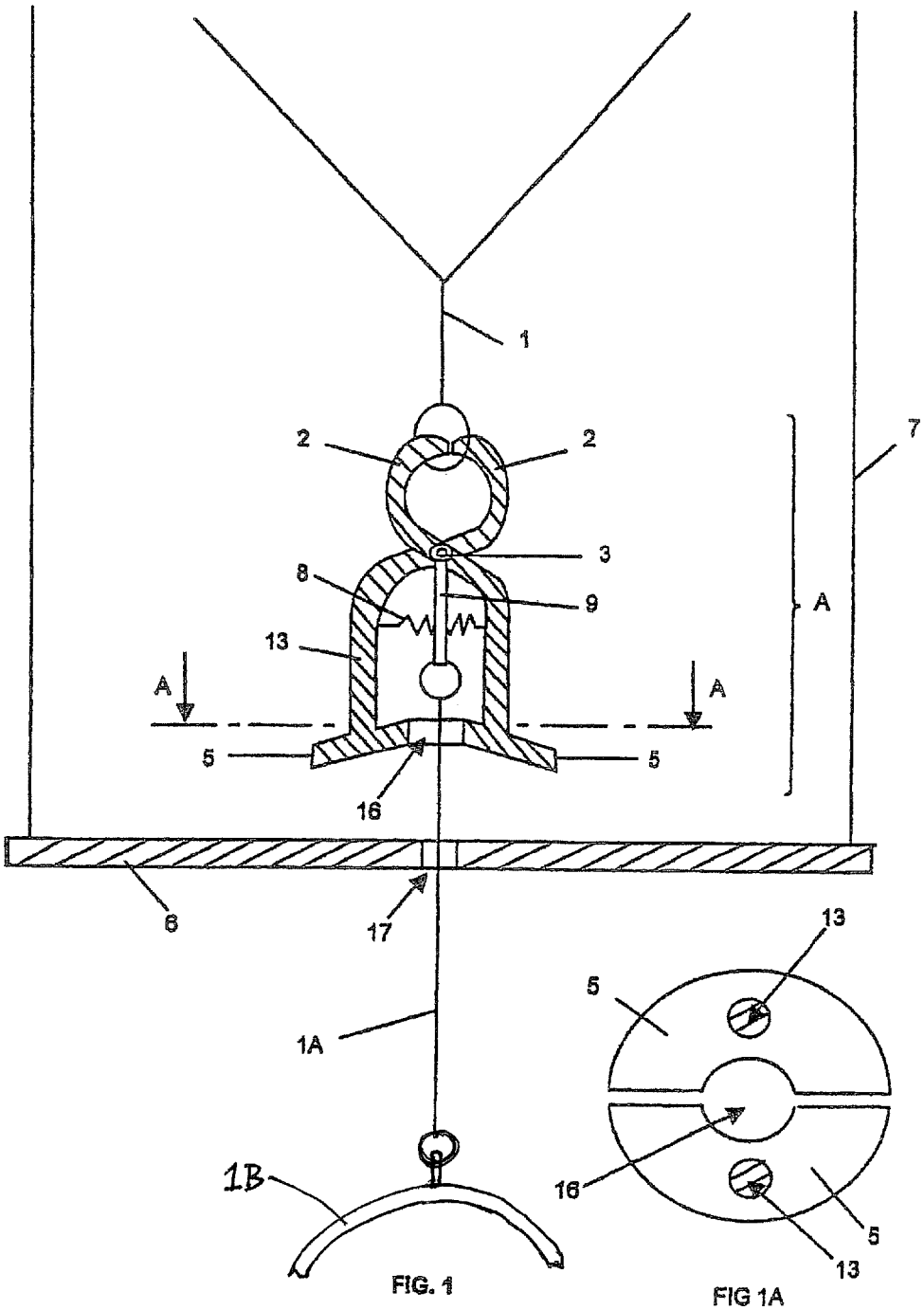
FIG. 1 shows in section the device of the invention (A).
Figure 2:
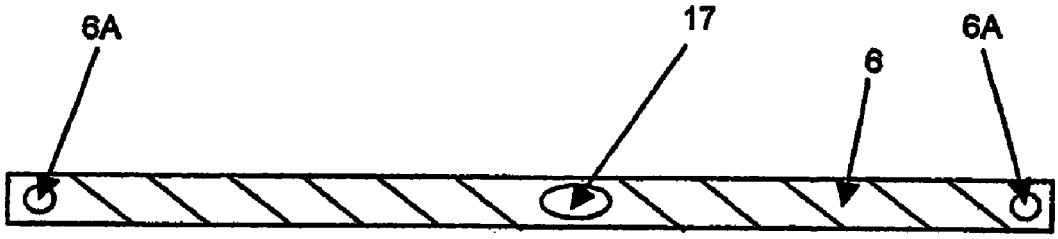
FIG. 2 depicts a bar (6) seen from above.
Figure 3:
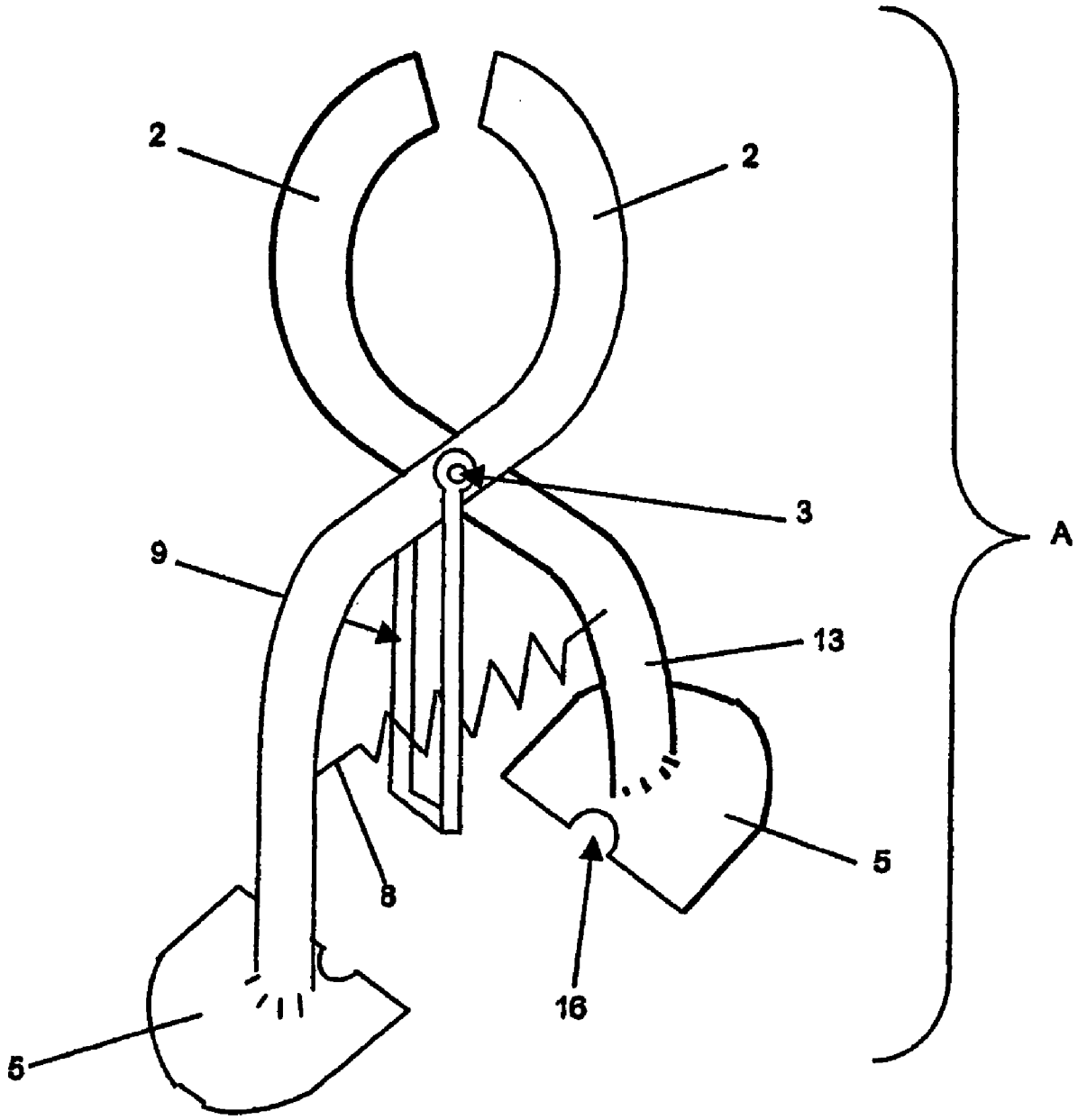
FIG. 3 depicts the clamp (A) with the jaws (2) and their bottom lugs (5) seen in perspective, in the half-open position.

With reference to these drawings, the device comprises:

the front lines (1) which terminate in a loop;

this loop is held by the jaws (2);

these jaws are articulated about a spindle (3);

this spindle forms a part of a shackle (9) which serves to connect a cord (1A), which is attached to the harness (1B) of the user;

the two jaws (2) are extended in the opposite direction to the spindle (3) by broadened lugs (5), themselves connected to a spring (8) which resists a stretching of several daN of force, in order to resist unwanted opening;

the bar (6) is connected at its ends (6A) to the rear lines (7) of the kite and at the central part comprises an opening (17) allowing the passage and guidance of the length (1A) attached to the user, of the front line (1), which is itself connected to the articulated shackle (9) of the clamp (A) which, at its jaws (2), holds the front lines (1) of the kite under the effect of the return spring (8) of the arms (13) opposite to the jaws (2) and provided at the rear end with broadened lugs (5), with a slightly frusto-conical shape with a central recess (16) in order to allow passage of the line (4) attached to the user. When the wind inflates the kite and the user releases the bar (6), the separation of the jaws (2) causes the release of the front lines (1) because the bar (6) comes into abutment on the lugs (5) so as to separate them counter to the spring (8).

According to another variant, the system for opening the jaws (2) can be actuated by an arm extending one of the two jaws through its side opposite to the spindle; this arm terminates in a ring, closed or not, in the horizontal position and perpendicular to the length (1A) or slightly at an angle with respect to the length (1A) and surrounding the length (1A). The circular shape of the ring (5, 5', 5" or 5''') makes it possible to accept that the bar (6) comes to push the ring (5, 5', 5" or 5''') according to any angle and any direction and therefore cause the opening of the jaws (2) or snap hook (11).

According to another variant, not illustrated, the device can comprise a spring which functions by pressure in order to open the jaws (2) rather than by stretching: the spring can then be fixed between one of the jaws (2) and the bottom arm (13) of the opposite jaw (2).

According to another variant, not illustrated, the device can comprise an elastic in place of a spring (8). When a jaw clamp (A) is used rather than a snap-hook clamp (A'), the jaws (2) can when closing touch edge to edge, or overlap over a few millimetres at their end, in order to close so as to trap the front lines (1).

According to another variant, not illustrated, the opening of the jaw clamp (A) or snap-hook clamp (A') can be caused by a wire connected to one of the arms (13) (13A) or to the bottom jaw of the snap hook (11) and to the user: when the wire is under tension because of the inflation of the kite, the traction exerted on the wire pulls the jaw on the arm and actuates by rotation the opening of the jaw clamp (A) or snap-hook clamp (A').

By way of non-limiting example, the jaws (2) will have dimensions around 1.25 cm for the width of each jaw, 3.5 cm for the height of the jaws and 0.5 cm for the thickness of the jaws. The arms (13) opposed by the spindle (3) comprise lugs (5) flattened obliquely in the form of a semi-circle with a diameter of 5 cm.

Figure 4:
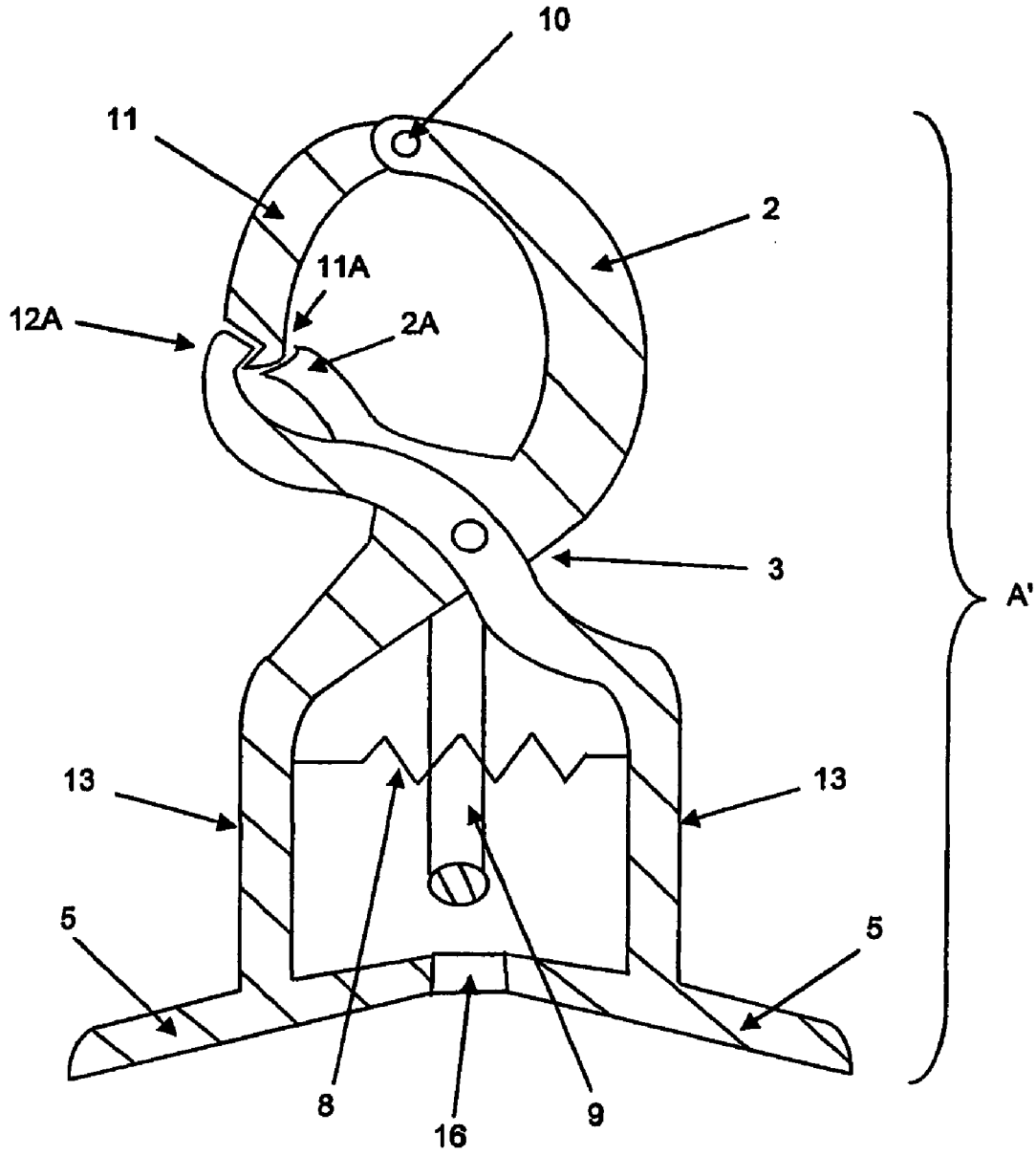
FIG. 4 depicts in section a variant of this device (A'). The form of the system (12) for locking the movable arm (11) of the snap hook can vary.
Figure 5:
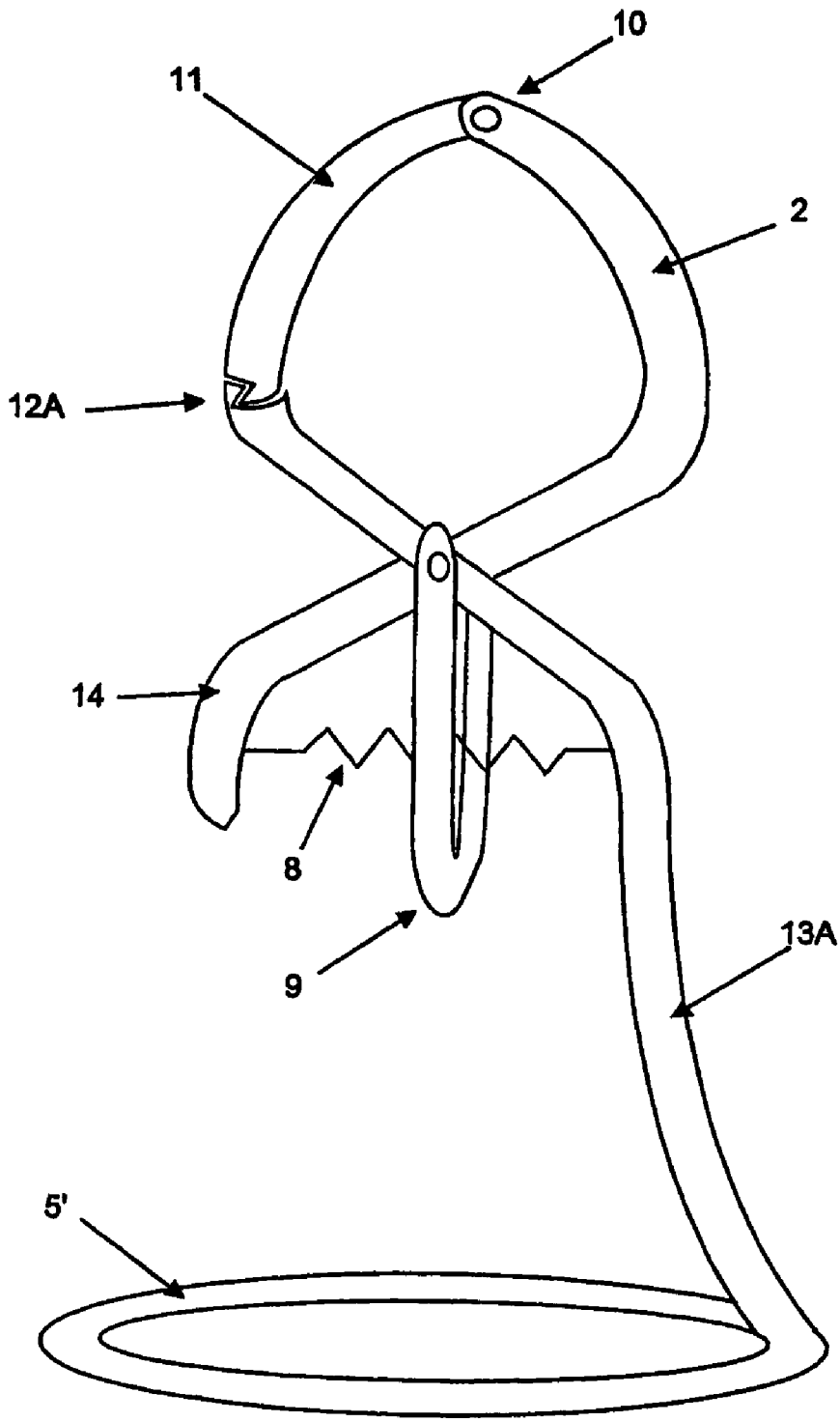

The clamp (A) or the snap hook (A') must withstand a load of 1000 daN when they are closed. They must be able to open by means of a pressure of a few daN effected on one or other of the lugs (5). They must preferably be produced from stainless steel or composite material, of the Kevlar carbon type or reinforced plastics material. In a variant of the embodiments illustrated above:

FIG. 5 depicts a variant of FIG. 4 relating to a snap hook in which instead of the two arms (13) a single arm (13A) is provided, extended by a single annular-shaped lug (5'), the other arm (13) being replaced by an extension (14) with no lug and to which the spring (8) is directly attached. The lug (5') is placed more or less perpendicular with respect to the length (1A) so as to surround it and always guide the bar (6) by means of the length (1A). FIG. 5 also shows a variant of FIG. 4 in that the hook (11A) (12A) formed by the snap hook (11) and the arm (13) can have several forms: in order to prevent the snap hook (11) pivoting inside the clamp (A'), a stop notch (2A) can be placed on the arm to which the hook (11A) of the snap hook (11) is attached, or on the arm (2) around which the snap hook (11) pivots by means of the spindle (10).

Figure 6:
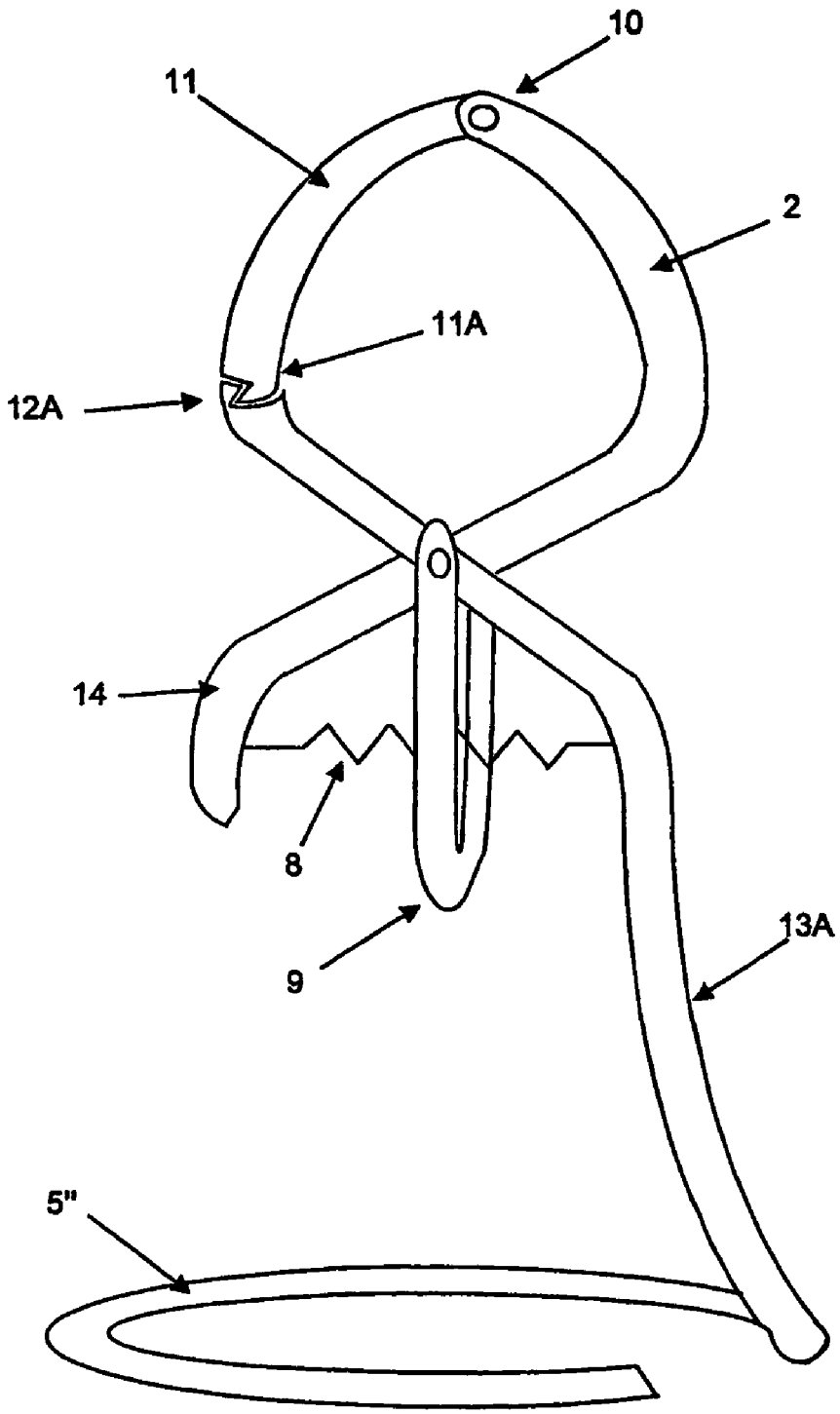

FIG. 6 depicts a variant of FIG. 5 relating to a single arm (13A) extended by a single lug (5"), circular in shape but not completely closed.

Figure 7:
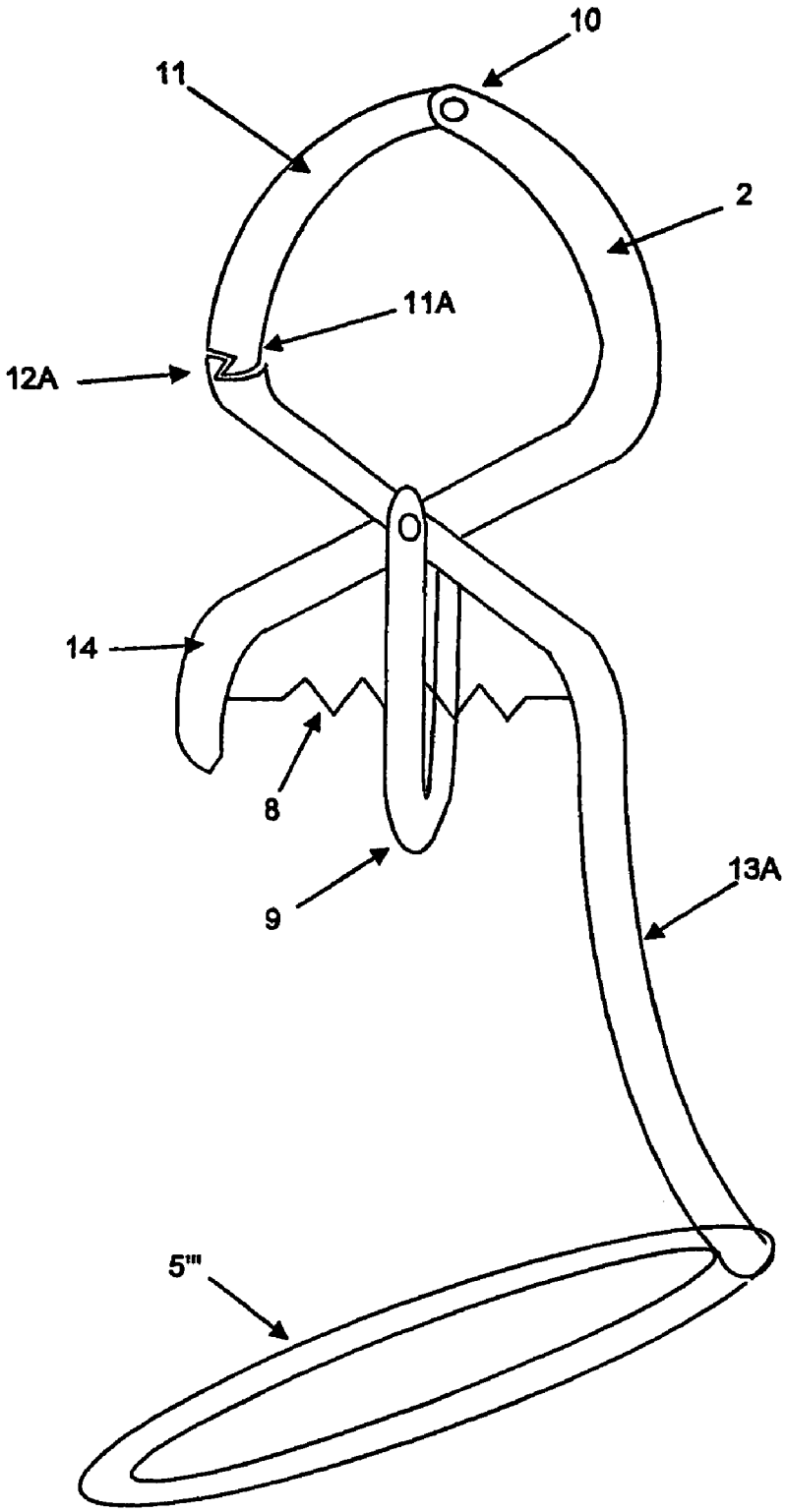

FIG. 7 is a variant of FIG. 6 relating to the arm extended by a circular lug which may be curved, banana-shaped or in general terms non-planar.

Figure 8:
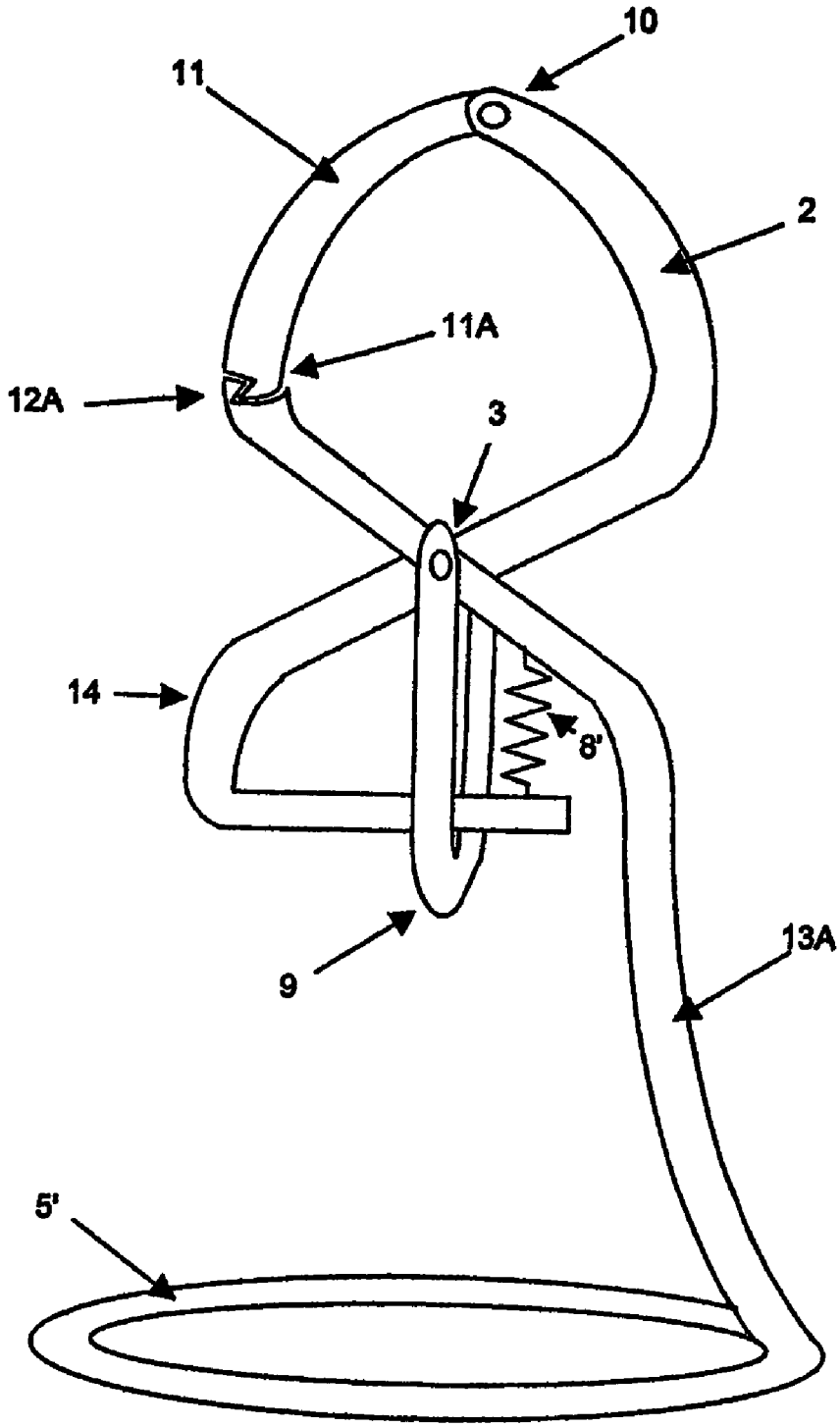

FIG. 8 is a variant of FIG. 7: the spring (8') is placed vertically between the arm (13A) extended in its bottom part by the circular arm (5') and the opposite arm (14), which is angled in order to return under the other arm, so as to form an S, and connect the spring (8') to the two arms. The angled arm forms an S and pivots at its centre about the spindle (3). The top part of the S connects the snap hook (11) by means of the spindle (10), and the bottom part of the S is connected to the other arm (13A) by the spring (8).

Figure 9:
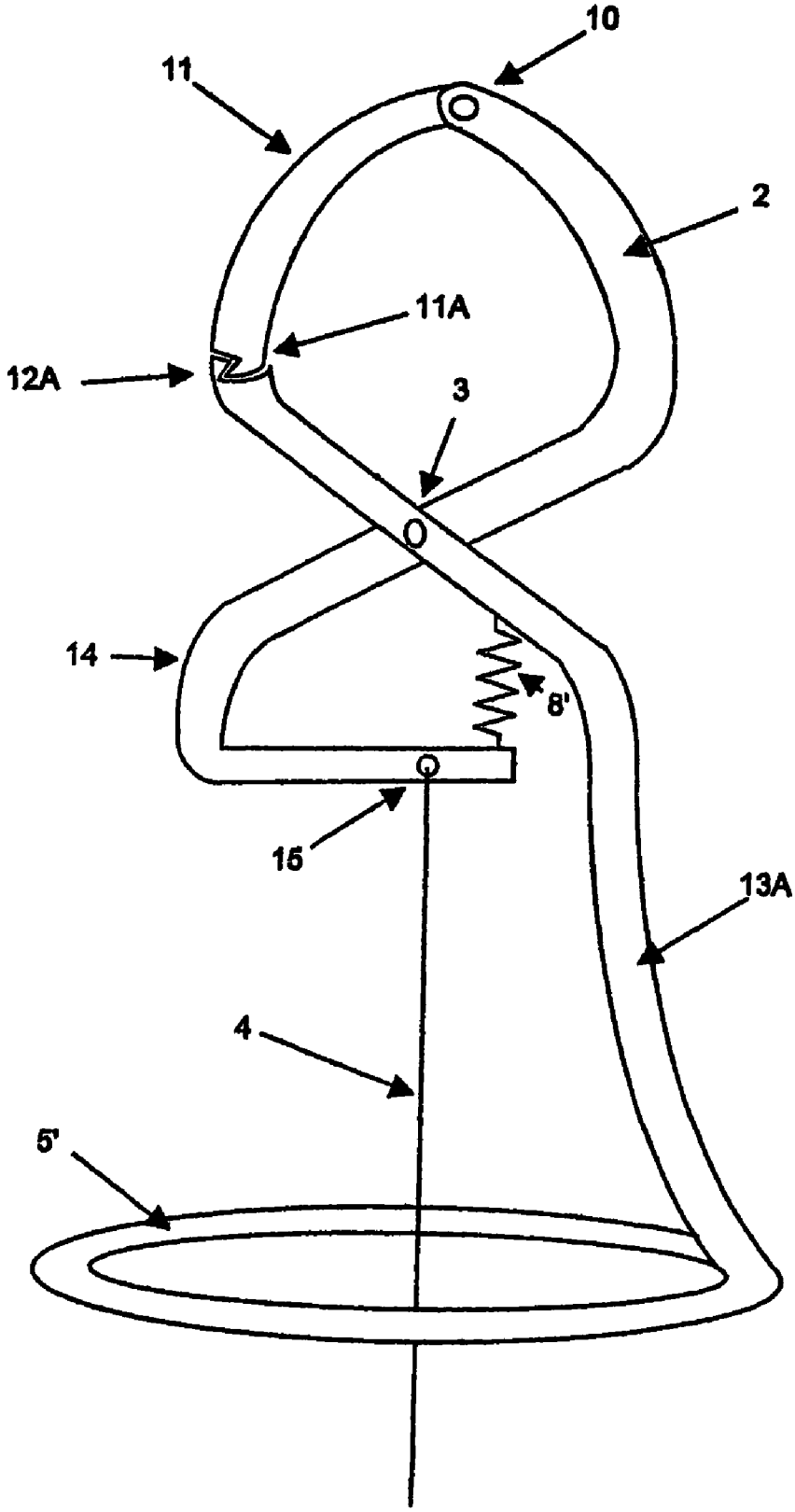

FIG. 9 is a variant of FIG. 8: the central spindle of the snap-hook clamp no longer comprises any shackle (9), and the length (1A) is directly attached to the bottom part of the S-shaped angled arm (15).

Figure 10:
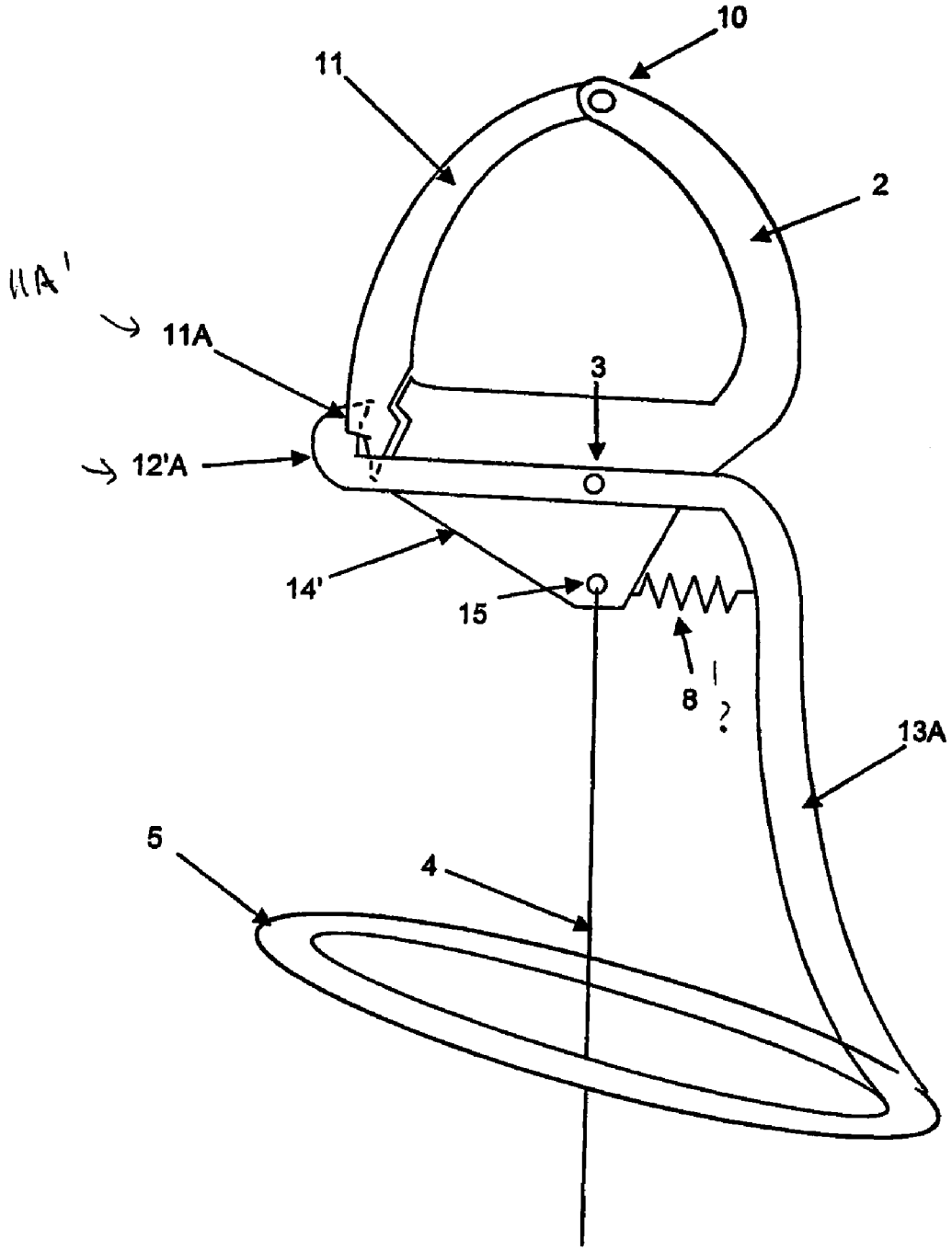

FIG. 10 is a variant of FIG. 9: the snap hook (11) comprises a hook (11A') which is held in the closed position by the arm (12'A); the snap hook (11) comprises a rim (11A') placed in its bottom part and forming a protrusion towards the outside of the snap-hook clamp (A') which prevents the arm (12A') from rising when it pivots. The arm (12'A) encloses the hook from the outside, under the protrusion (11A') of the snap hook. The spring (8') is placed horizontally between the two arms (13A), under the central spindle (3). The bottom arm to which the front length (1A) is connected by the junction point (15) may be solid, as in FIG. 10, or angled in the form of an S.

Figure 11:
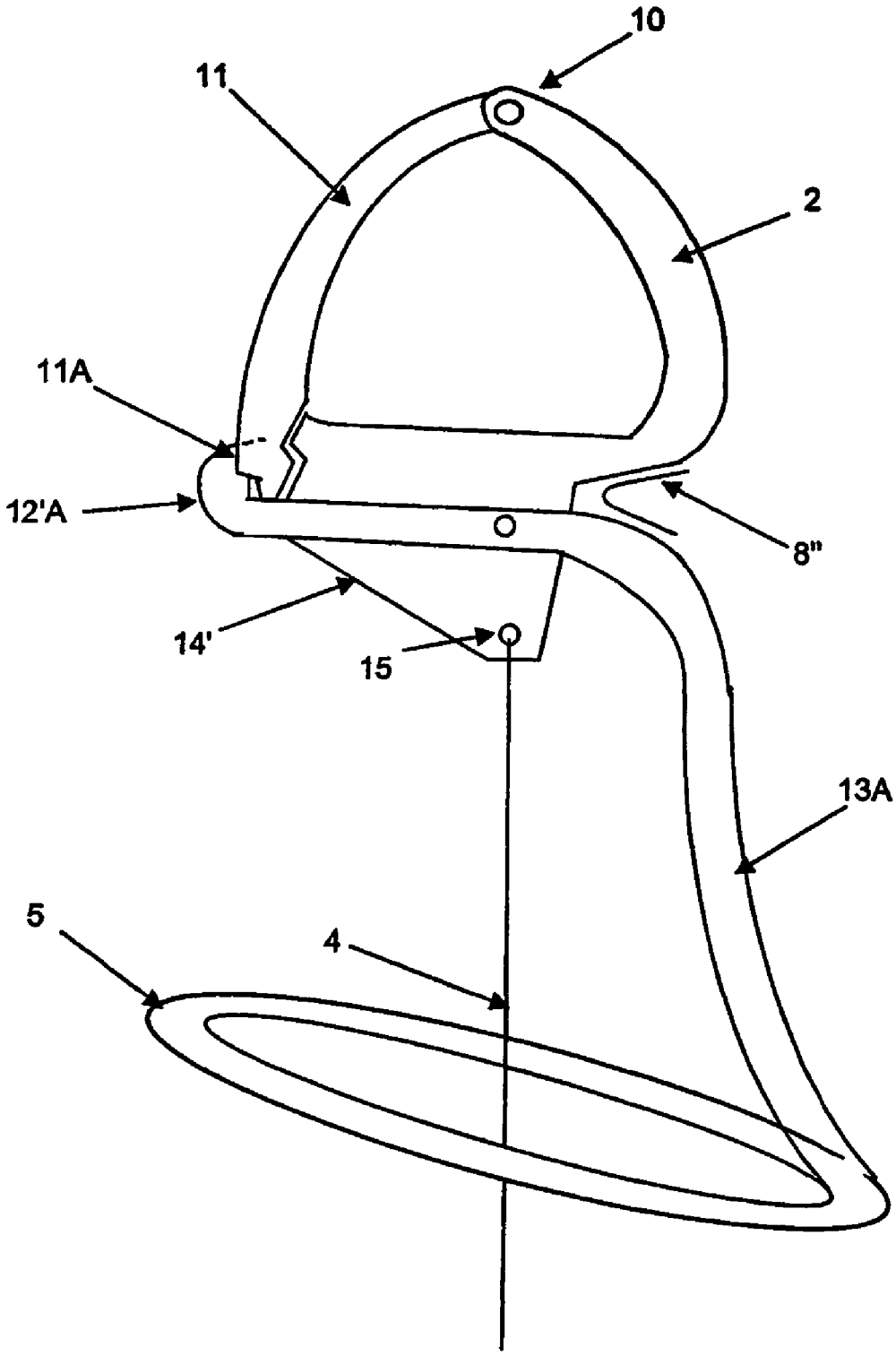

FIG. 11 is a variant of FIG. 10: the spring is a spring with an angled leaf spring (8"), placed under the jaw (2) opposite to the snap hook (11) and above the arm (13A).

DETAILED DESCRIPTION OF THE PREFERRED EMBODIMENT(S)

Another variant, not illustrated, would consist of replacing the leaf spring with a piston function according to the principle of a car damper.

Industrial application: the invention must be produced according to the same criteria of strength and durability as a sailboard wishbone or a marine snap hook. The invention, in general terms, relates to a device making it possible to unhook the front traction lines or wires of a traction sail of the kite or paragliding type attached to a user on the ground or on a mobile support such as a board, a sand sail device, a snowboard, or a skateboard, the said user holding a bar at the ends of which there are connected the rear traction lines or wires of the sail in order to control its orientation and its power by traction on the said bar more or less close to the body of the user, of the type consisting of a holding means interposed on the front lines, releasable, characterised in that the said releasable holding means (A) (A') is disposed on the front lines (1) beyond the traction bar (6) and comprises articulation means forming a clamp (A) or snap hook (A'), held in the closed position by an elastic means (8) (8') (8"), and in that they are connected to at least one pivoting arm (13) provided at its free end opposite the bar (6) with a lug (5) (5') (5") (5''') conformed so as to bear against the said bar (6) when the latter is released, accidentally or not, by the user in order to cause an angular pivoting of the said at least one arm (13) then automatically ensuring the release of the part of the front lines (1) disposed beyond the holding device and subsequently the total release of the user and his safety because the kite is no longer held in shape and can then fall freely.

According to other particularities, the device is characterised in that the jaw clamp (A) or snap-hook clamp (A') can be kept closed by a spring (8), which may be helical, made from stainless steel or rubber elastic, with a twisted leaf (made from metal or plastics), or of the piston, push button, ram or damper type or a damper similar to those on a car.

According to other particularities, the device is characterised in that the elastic means of closing the jaw clamp (A) or snap-hook clamp (A') can consist of a rubber elastic.

According to other particularities, the device is characterised in that an arm (13A) of the jaw clamp (A) or snap-hook clamp (A') can be extended in its bottom part by a circular ring (5), (5'), (5"), (5'''), closed or not, surrounding the front length (1A) and guided by the latter, oriented horizontally and perpendicular to the front length (1A) or slightly at an angle with respect to the horizontal; the circular shape of the ring (5), (5'), (5"), (5''') enables the bar (6) to always touch the ring and therefore to cause the opening of the jaw clamp (A) or snap-hook clamp (A') whatever the orientation of the bar (6) at the moment it comes into contact with the ring (5), (5'), (5"), (5''').

According to other particularities, the device is characterised in that the spring (8) can prevent the opening of the jaw clamp (A) or snap-hook clamp (A') by stretching or contraction, according to the point where it is placed (eg: either between the two arms (13) (13A) or between an arm (13) (13A) and a jaw (2), or between the two jaws (2), or between the snap hook (11) and the jaw (2)).

According to other particularities, the device is characterised in that the lugs (5) can have solid or hollowed-out frustoconical shapes.

According to other particularities, the device is characterised in that the opening of the jaw clamp (A) or snap-hook clamp (A') can, in addition or alternatively, be caused by a wire connected to the bottom end of an arm (13) (13A) and to the user or to the front length (1A), connected before the device.

According to other particularities, the device is characterised in that the ring (5) (5') can pivot at the point where it is connected to the arm (13) (13A).

According to other particularities, the device is characterised in that the arm (13) (13A) can be articulated in order to pivot about a horizontal rotary spindle, under the action of the bar (6) which comes to touch the ring (5) (5').

According to other particularities, the ring (5) (5') can be replaced by a tube of greater or lesser length; this tube can even be disconnected from the arm (13) (13A). It then comes into abutment against the arm (13) (13A) in order to cause the opening of the jaw clamp (A) or snap-hook clamp (A'). According to another variant, the tube can act in the form of a piston, which causes the opening of the jaw clamp (A), itself inverted vertically with respect to FIGS. 1/11, where the clamps are formed by brackets which are separated by the pressure of the tube (5) (5'). According to another variant, the tube can come into abutment against a piston: this piston keeps connected two bevelled tubes inverted with respect to each other, because the two bevelled parts are fitted one against the other by two rails and immobilised at their centre by the piston which passes through them: when the tube comes into abutment against the piston, the piston rises sufficiently, so as to make the piston rise to enable the two bevelled parts to slide by virtue of their rails.

According to other particularities, the device is characterised in that the axis of the shackle (9) can pivot about a horizontal rotary spindle fixed underneath the jaw clamp (A) or snap-hook clamp (A').

According to other particularities, the device is characterised in that the system of fixing the hook (11A) of the snap hook (11) can come into abutment against a protrusion on the opposite jaw (2) or on the bottom jaw (12A) of the snap hook (11), or a combination of the two.

According to other particularities, the device can comprise a ring fixed to the jaw (2) of the snap hook, serving to fix a leash, which will be connected at its other end to the front lines (1) so as to hold the front lines (1) in the event of opening of the snap hook.

The invention claimed is:

1. A kite surfing apparatus for use by a user, the apparatus comprising:

a kite or paragliding type wing;

a traction line extending from the kite or paragliding type wing to connect the kite or paragliding type wing to the user or to a mobile support on which the user is riding; and a release system connected to the traction line and configured and positioned to be interposed between the user or the mobile support and the traction line, the release system including a releasable holding device including:

a clamp movable between an open position and a closed position;

a pivot arm connected to the clamp to pivot about a pivot axis, the pivot arm including first and second arm segments located on opposed sides of the pivot axis, wherein:

the pivot arm is pivotable relative to the clamp about the pivot axis between a locking position, wherein the first arm segment holds the clamp in the closed position, and a releasing position, wherein the first arm segment permits the clamp to open; and the pivot arm can be pivoted from the locking position to the releasing position by applying a load to the second arm segment and thereby causing the pivot arm to pivot about the pivot axis; and a biasing device operative to hold the pivoting arm in the locking position;

wherein, upon releasing the clamp using the pivot arm with the traction line under tension from the kite or paragliding type wing, the clamp will move to the open position to enable release of the traction line under tension from the user or mobile support.

2. The apparatus of claim 1 wherein the clamp includes a snap hook.

3. The apparatus of claim 2 wherein the snap hook includes a jaw, and at least one of the jaw and the first arm segment includes a protrusion configured to engage and interlock with a mating feature of the other of the jaw and the first arm segment to hold the clamp in the closed position.

4. The apparatus of claim 1 wherein the clamp includes a pair of relatively pivotable opposed jaws.

5. The apparatus of claim 1 wherein the biasing device includes a leaf spring.

6. The apparatus of claim 1 wherein the biasing device includes a spring that is compressed when the pivot arm is in the locking position.

7. The apparatus of claim 1 wherein the pivot arm is pivotable from the locking position to the releasing position against the force of the biasing device.

8. The apparatus of claim 1 wherein the traction line is connected to the user.

9. The apparatus of claim 1 including a harness to be worn by the user and to secure the traction line to the user with the releasable holding device interposed between the harness and the traction line.

10. The apparatus of claim 1 including a traction bar and a second traction line connecting the kite or paragliding type wing to the traction bar, wherein the first traction line is a front traction line and the second traction line is a rear traction line.

11. The apparatus of claim 9 wherein the second arm segment is configured and positioned to bear against the traction bar when the traction bar is released by the user to thereby forcibly pivot the pivot arm from the locking position to the releasing position.

12. The apparatus of claim 1 including a rotary pin about which the pivot arm pivots between the locking and releasing positions.

13. A release system for use by a user with a kite or paragliding type wing and a traction line extending from the kite or paragliding type wing to releasably connect the kite or paragliding type wing to the user or to a mobile support on which the user is riding, the release system being configured to be connected to the traction line and interposed between the user or the mobile support and the traction line, the release system comprising a releasable holding device including:

a clamp movable between an open position and a closed position;

a pivot arm connected to the clamp to pivot about a pivot axis, the pivot arm including first and second arm segments located on opposed sides of the pivot axis, wherein:

the pivot arm is pivotable relative to the clamp about the pivot axis between a locking position, wherein the first arm segment holds the clamp in the closed position, and a releasing position, wherein the first arm segment permits the clamp to open; and the pivot arm can be pivoted from the locking position to the releasing position by applying a load to the second arm segment and thereby causing the pivot arm to pivot about the pivot axis; and a biasing device operative to hold the pivoting arm in the locking position;

wherein, upon releasing the clamp using the pivot arm with the traction line under tension from the kite or paragliding type wing, the clamp will move to the open position to enable release of the traction line under tension from the user or mobile support.

* * * * *